US005870874A

United States Patent [19]

Brothers

[11] Patent Number: 5,870,874

[45] Date of Patent: Feb. 16, 1999

[54] MEANS FOR SPACING AND FASTENING STRUCTURAL MEMBERS IN JUXTAPOSITION

[76] Inventor: Jack Brothers, 806 Tuxedo Dr., Fort Walton Beach, Fla. 32548

[21] Appl. No.: 907,377

[22] Filed: Aug. 7, 1997

[51] Int. Cl.[6] ..... E04C 3/02; E04C 3/30

[52] U.S. Cl. ..... 52/696; 52/712

[58] Field of Search ..... 52/712, 696, 698, 52/735.1

[56] References Cited

U.S. PATENT DOCUMENTS

| | | | |
|---|---|---|---|
| 2,964,807 | 12/1960 | Kennedy | 20/9 |
| 3,672,112 | 6/1972 | Sions et al. | 52/712 |
| 4,080,771 | 3/1978 | Weller | 52/735 |
| 4,965,980 | 10/1990 | Leavens | 52/712 |
| 5,437,137 | 8/1995 | Allen | 52/712 |

*Primary Examiner*—Christopher Kent
*Assistant Examiner*—Yvonne Horton-Richardson
*Attorney, Agent, or Firm*—Bernard J. Murphy

[57] ABSTRACT

A strip of sheet metal stock, having a plurality of serially-arranged holes formed therein is provided for fastening of the strip to a top plate of a building structure. The strip, further, has pairs of tabs formed therein which can be pried up from the plane of the strip, and put into vertical dispositions, to receive a rafter or truss between the paired, and vertically-disposed tabs. Holes in the tabs provide for the fastening of the emplaced rafters or trusses to the tabs. The pairs of tabs are uniformly spaced apart from other pairs thereof a distance which obtains between rafters or trusses according to conventional construction codes. An indeterminate supply of the strip can be stored on, and payed out from, a reel.

1 Claim, 1 Drawing Sheet

MEANS FOR SPACING AND FASTENING STRUCTURAL MEMBERS IN JUXTAPOSITION

This invention pertains to building construction aids, and in particular to means for spacing and fastening structural members, such as rafters and trusses, in juxtaposition.

Structural members spacing means, and spacing and fastening means are well known in the prior art, and typical thereof are U.S. Pat. Nos. 2,964,807; 4,490,956; and 4,604,845. U.S. Pat. No. 2,964,807 issued on Dec. 20th, 1960, to R. E. Kennedy, for Joist Spacer and Support. It appears to be quite serviceable for the intended purpose, but it is of somewhat complicated structure. It requires inner and outer strips, fastened together, with preformed, right-angular flanges. The U.S. Pat. No. 4,490,956 was issued to Joaquin J. Palacio, et al, for a Truss Spacer. The invention in the latter patent requires a U-shaped channel member with specially-formed plates at opposite ends, the plates having slots, spacing members and teeth. Each of the Truss Spacers spaces between but two trusses. Finally, the last-cited U.S. Pat. No. 4,604,845, issued to Sheridan F. Brinker, on Aug. 12th, 1986, for a Continuous Pivoted Spacing Tie, requires a plurality of separate spacer segments, pivotably joined, and an upstanding tab for engaging a first beam in an array thereof.

The prior art examples of means for spacing and fastening structural members in juxtaposition are deemed to be unnecessarily complex and expensive. There has been a long-felt need for a simple means, a means of facile utility which warrants no expensive forming or other, involved manufacturing requirements.

It is an object of this invention, then, to disclose means which meets the aforesaid need. Particularly, it is an object of this invention to set forth means for spacing and fastening structural members in juxtaposition, comprising an elongate strip of material,of uniform width and thickness; said strip having first means for fastening said strip to a bearing surface; and said strip further having a plurality of uniformly spaced apart second means manipulative for straddling structural members.

Further objects of this invention, as well as the novel features thereof, will become apparent by reference to the following description, taken in conjunction with the accompanying figures, in which.

Figure 1:
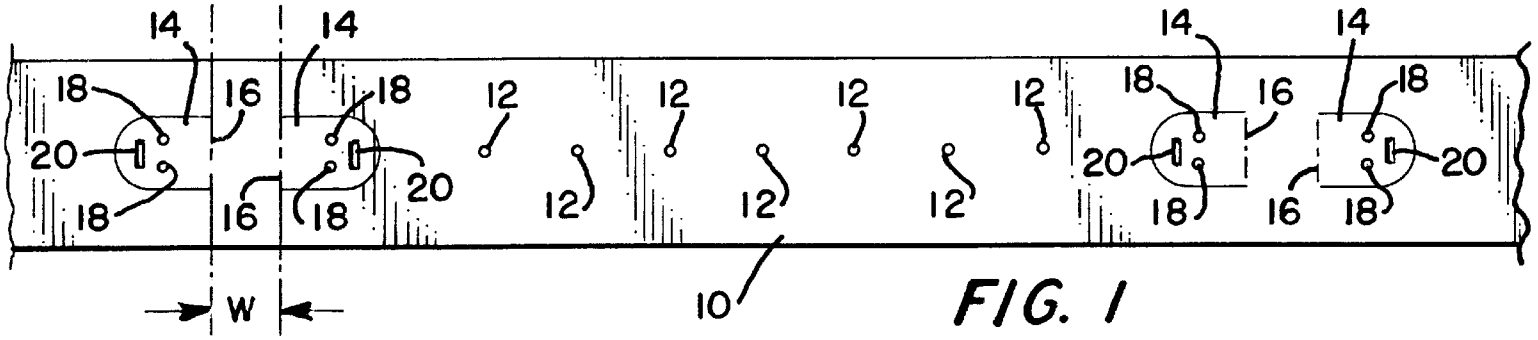
FIG. 1 is a plan view of a portion of the novel strip of material, the same clearly showing the cut-out tabs, fastening holes, and screwdriver lift slots.
Figure 2:
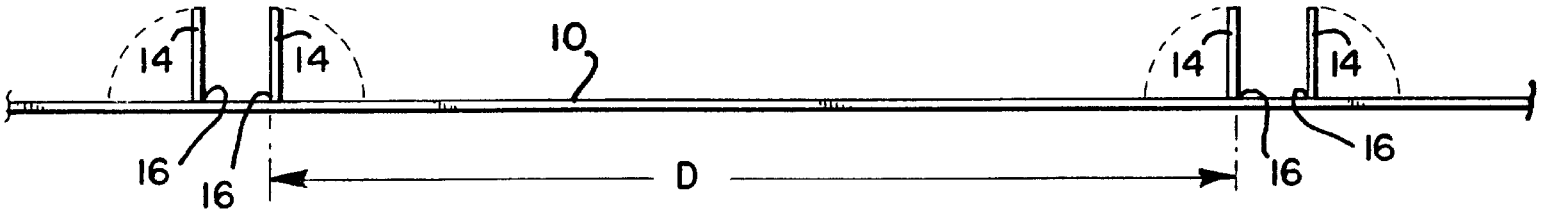
FIG. 2 is a side elevational view of the strip of FIG. 1 in which, however, the tabs are shown raised up into vertical disposition.

As shown in FIGS. 1 and 2, the novel strip of material 10 has one, uniform width, and one, uniform thickness. By way of example, the material comprises twenty to twenty-two gauge sheet metal stock. The strip of material 10 has a plurality of fastener holes 12 formed therein, the same serially arranged lengthwise of the material, for receiving fasteners for securing the material 10 to a bearing surface. Typically, the strip of material 10 would be secured to the top plate (not shown) of a building structure, by fixing fasteners through the holes 12.

To space and fasten structural members, such as rafters or trusses, in juxtaposition, the strip of material 10 has a plurality of uniformly spaced apart means for straddling such rafters of trusses. Such means comprises tabs 14, paired together, and spaced therebetween by a dimension "W" which corresponds to the width of standard rafters and trusses. Each tab 14 is cut free of the strip of material 10 on three sides, and a fourth side 16 defines a fulcrum and anchor end thereof. Each tab 14 has a pair of fastener holes 18 formed therein for receiving fasteners for fixing in rafters or trusses straddled by the tabs 14.

As depicted in FIG. 2, the tabs 14 are raised up, out of the plane of the strip of material 10, to set astride a rafter or truss. To facilitate the elevation of the tabs 14 to the vertical disposition, each thereof has a screwdriver lift slot 20 formed therein.

The pairs of tabs 14 are formed in the strip of material 10 at recurring, equally-spaced apart locations which define a distance "D" therebetween which corresponds to the distance obtaining between rafters or trusses according to conventional construction codes.

In use, then, the strip of material 10 is fastened to a bearing surface, i.e., a top plate of a building structure, or such, by putting fasteners into the bearing surface via the holes 12. Then, with the use of a screwdriver, or other suitable tool, the tabs 14 are pryed up from the plane of the strip of material 10. The screwdriver, or such tool, is addressed to the slots 20 provided therefor in the tabs 14. By means of a hammer or pliers, or such, the pryed-up tabs 14 are raised to vertical dispositions, as shown in FIG. 2. Now then, the novel strip of material is ready to receive the rafters or trusses between the paired tabs 14. With rafters or trusses emplaced between the paired, and vertical tabs 14, they are then secured in place by fasteners fixed therein via the holes 18.

Figure 3:
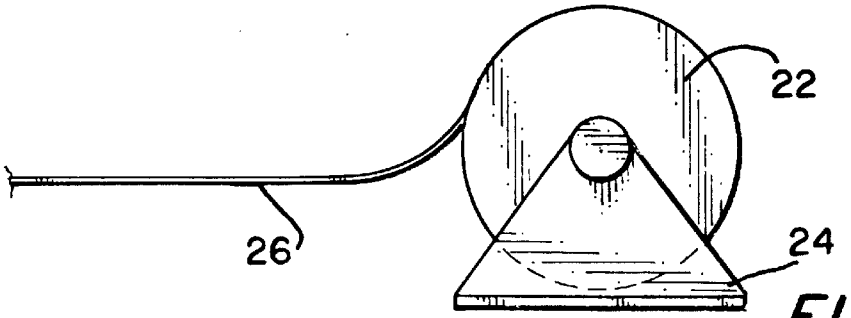
FIG. 3 depicts a reel upon which is wound an indeterminate length of the novel strip material.

In that the strip of material 10 has a uniform thickness, it lends itself to supply by reel. As shown in FIG. 3, a reel 22, having a trunnion support 24, has an indeterminate supply of the strip material 10 thereon. A leading end 26 of the strip of material 10 is shown payed out from the reel 22, for severing of a length thereof for use.

While I have described my invention in connection with a specific embodiment thereof, it is to be clearly understood that this is done only by way of example, and not as a limitation to the scope of the invention, as set forth in the objects thereof, and in the appended claims.

What is claimed is:

1. In combination, a reel and means for spacing and fastening structural members in juxtaposition, comprising:

an elongate, uniplanar, strip of material, of uniform width and thickness;

said strip having first means for fastening said strip to a bearing surface; and said strip further having a plurality of uniformly spaced apart second means manipulative for straddling structural members; wherein each of said second means comprises a pair of proximately disposed tabs formed in said strip;

each of said tabs, of each of said pair, has a plurality of fastener holes formed therein for receiving fasteners therethrough at opposite sides of a structural member; and said strip of material is wound upon said reel for pay-out therefrom.

* * * * *